US010129669B2

(12) United States Patent
Harris

(10) Patent No.: US 10,129,669 B2
(45) Date of Patent: Nov. 13, 2018

(54) PERSONAL HEARING DEVICE

(71) Applicant: Axil, LLC, Draper, UT (US)

(72) Inventor: Weston T Harris, Lindon, UT (US)

(73) Assignee: AXIL, LLC, Draper, UT (US)

( * ) Notice: Subject to any disclaimer, the term of this patent is extended or adjusted under 35 U.S.C. 154(b) by 0 days.

(21) Appl. No.: 14/596,157

(22) Filed: Jan. 13, 2015

(65) Prior Publication Data

US 2015/0201291 A1 Jul. 16, 2015

Related U.S. Application Data

(60) Provisional application No. 61/927,298, filed on Jan. 14, 2014.

(51) Int. Cl.
*H04R 25/00* (2006.01)
*H04R 1/10* (2006.01)

(52) U.S. Cl.
CPC ..... *H04R 25/652* (2013.01); *H04R 1/105* (2013.01); *H04R 1/1066* (2013.01); *H04R 2225/025* (2013.01); *H04R 2460/09* (2013.01)

(58) Field of Classification Search
CPC .... H04R 1/1016; H04R 1/105; H04R 1/1066; H04R 5/0335; H04R 25/65; H04R 25/656; H04R 2225/023; H04R 2225/025; H04R 2460/09; H04R 2460/15; H04R 25/652; H04R 2201/107; A61F 11/06; A61F 11/08; H04M 1/05
USPC ..... 381/322, 324, 325, 326, 328, 329, 374, 381/380; 181/129, 130, 135; 128/864, 128/866, 867; 379/430
See application file for complete search history.

(56) References Cited

U.S. PATENT DOCUMENTS

| | | | | |
|---|---|---|---|---|
| 1,893,143 | A * | 1/1933 | Koch | 181/135 |
| 1,953,437 | A * | 4/1934 | Schier | 181/135 |
| 7,394,910 | B2 * | 7/2008 | Smith | H04R 1/1016 381/322 |
| 7,841,446 | B2 * | 11/2010 | Leong et al. | 181/135 |
| 8,121,325 | B2 * | 2/2012 | Atamaniuk | H04M 1/05 381/322 |
| 2006/0067556 | A1 | 3/2006 | Bailey et al. | |
| 2009/0095566 | A1 | 4/2009 | Leong et al. | |
| 2009/0214072 | A1 | 8/2009 | Staab et al. | |

(Continued)

FOREIGN PATENT DOCUMENTS

| | | | |
|---|---|---|---|
| EP | 1643800 | A2 | 4/2006 |
| WO | 2012138788 | A2 | 10/2012 |

OTHER PUBLICATIONS

PCT International Search Report for PCT International No. PCT/US2015/011478, dated May 6, 2015.

(Continued)

*Primary Examiner* — Huyen D Le
(74) *Attorney, Agent, or Firm* — Dorsey & Whitney LLP

(57) ABSTRACT

A universal personal hearing device is provided. The universal personal hearing device includes a first microphone, an amplification circuit electrically connected to the first microphone, a speaker electrically connected to the amplification circuit for amplifying ambient sound detected by the first microphone, and a housing having at least one arcuate outer edge. The arcuate outer edge is slidably engageable with the concha wall to provide a universal fit across a variety of ears having different sizes and/or shapes.

19 Claims, 5 Drawing Sheets

(56) References Cited

U.S. PATENT DOCUMENTS

| | | | | |
|---|---|---|---|---|
| 2011/0075871 | A1 | 3/2011 | Fretz et al. | |
| 2011/0123059 | A1* | 5/2011 | Hu | 381/380 |
| 2011/0155147 | A1 | 6/2011 | McIntosh | |
| 2011/0206225 | A1 | 8/2011 | Moller et al. | |
| 2012/0057739 | A1* | 3/2012 | Smith | H04M 1/05 381/379 |
| 2012/0237068 | A1* | 9/2012 | Fretz | H04R 25/656 381/330 |
| 2013/0136279 | A1 | 5/2013 | Brown et al. | |

OTHER PUBLICATIONS

Supplementary European Search Report for EP Application No. 15737273, dated Sep. 11, 2017 (3 pp.).

* cited by examiner

PERSONAL HEARING DEVICE

THE FIELD OF THE INVENTION

The present invention relates generally to the field of hearing devices, and more particularly to a hearing device that is usable as a universal personal sound amplifier.

BACKGROUND

The importance of hearing devices in today's society and the need to take care in protecting one's hearing from the very negative effects of hearing loss is becoming more and more apparent. It has been estimated that over 120 million Americans need to hear while working on the job or recreationally. Moreover, professional sources also estimate that over 35 million Americans need to hear better due to hearing loss. However, only 7-8 million of those have been willing to use the current distribution model of a traditional hearing clinic to get help.

There may be a variety of reasons why more people do not take advantage of the different options currently available for hearing enhancement. For example, one reason more people are not getting help may be due to the inefficiencies and expenses associated with the current distribution model of a traditional hearing clinic. In such settings, hearing devices are often customized for use with a particular individual. And, although there may be other options available, such as personal sound amplification products ("PSAP") which can be used to improve hearing performance in a variety of situations, there may still be some disadvantages associated with PSAP products currently available on the market. One such disadvantage is that ear size varies greatly across the general population such that a particular PSAP device that fits comfortable and in a stable fashion in one person's ear is not likely to have the same sort of fit in another persons ear.

There is thus a need for an improved hearing device that is easy to use in a substantially universal fashion.

SUMMARY OF THE INVENTION

It is an object of the present invention to provide a universal personal hearing device.

According to one aspect of the invention, a hearing device may include a first microphone, an amplification circuit electrically connected to the first microphone, a speaker electrically connected to the amplification circuit for amplifying ambient sound detected by the first microphone, and a housing having at least one arcuate outer edge. The arcuate outer edge may be part of a larger circle and configured to align with the concha area when the hearing device is placed in an ear. The arcuate outer edge may allow the housing to slidably engage the concha area of the ear, so that the hearing device is stably and comfortably held in the ear regardless of the size of the particular ear.

According to another aspect of the invention, a hearing device includes a housing having a first section and a second section, the first section comprising an arcuate outer edge. The arcuate outer edge of the first section may be part of a larger circle and configured to align with the concha area when the hearing device is placed in an ear while the second section aligns to the ear canal.

According to another aspect of the invention, a hearing device includes a housing having a first section with a substantially circular design and a second section with a substantially circular design. In at least one embodiment, the first section is larger than the second section. Additionally, there may be a transition space between the first section and the second section. An outer edge of the first section may be configured to align with the concha area when the hearing device is placed in an ear while the second section aligns to the ear canal. This two-circle design may allow the hearing device to roll up or down in the outer ear according to whatever the person's ear shape or size is.

According to another aspect of the invention, the hearing device may be a personal sound amplification product ("PSAP").

According to another aspect of the invention, the hearing device may have a design that allows for a true unplugged, open feeling while maintaining a small in the ear, hearing device for all ears. For example, the design may include a very slim port that goes into the ear allowing an open ear tip to be placed on it, leaving the ear canal completely open and natural. Alternatively, a foam tip may be placed on the port for maximum hearing protection. This is a critical point to be able to provide an affordable, yet highly effective solution, for hearing enhancement or hearing protection to help tens of millions of Americans have easy access to effective solutions for their hearing needs.

According to another aspect of the invention, a hearing device includes a housing and one or more attachment members for engaging the housing. The attachment member may releasably engage the housing to aid in the retention of the hearing device when the hearing device is placed in an ear.

These and other aspects of the present invention are realized in an improved universal hearing device and methods of using the same.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment" or "an embodiment" means that a particular feature, structure, or characteristic described in connection with the embodiment is included in at least one embodiment. The appearances of the phrase "in one embodiment" in various places may not necessarily limit the inclusion of a particular element of the invention to a single embodiment, rather the element may be included in other or all embodiments discussed herein.

Figure 1:
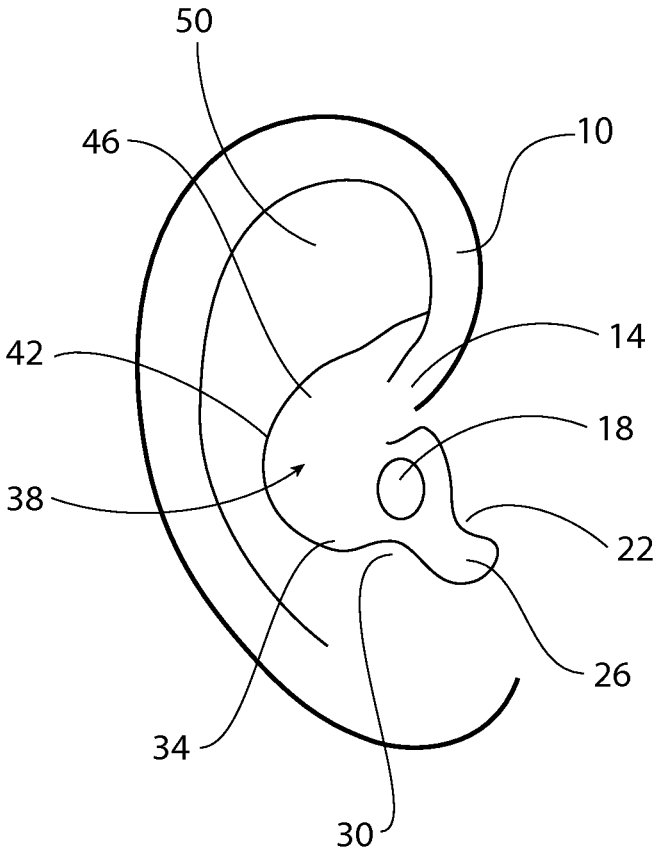
FIG. 1 shows a typical human ear.

Turning now to FIG. 1, for illustration purposes and to aid in the understanding of the placement of the present invention, a typical human ear is shown in FIG. 1. The outer ear, or pinna, is an irregularly concave cartilaginous member including a number of eminences and depressions which give each ear a distinct shape and form. The helix 10 is the curved outer rim of the ear. Below the helix 10 is the antihelix 50. The antihelix 50 is a curved prominence which describes a curve around the concha 38, a deep cavity containing the entry to the ear canal 18. The concha 38 is divided into two parts, the upper concha 46 and the lower concha 34, by the crux of the helix 14 which curves around the outside of the ear, and extends inwards at about the vertical midpoint of the ear. The upper concha 46 lies above the crux of the helix 14 and below the antihelix 50. The lower concha 34 lies below the crux of the helix 14 and surrounds the entry to the ear canal 18. The concha wall 42 separates the concha 38 from the antihelix 50. In front of the lower concha 38 and projecting backwards from the front of the ear is the tragus 22, a small semicircular prominence. Opposite the tragus 22 and separated from it by the deep curvature of the intertragic notch 26 is the antitragus 30. The intertragic notch 26 is formed between the tragus 22 and the antitragus 30.

Figure 2A:
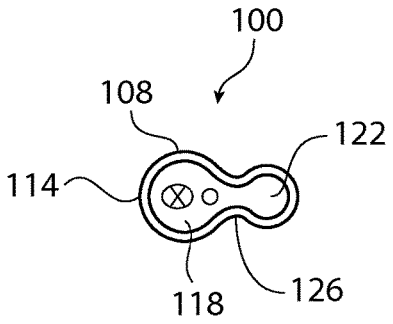
FIG. 2A shows a front view of a hearing device according to principles of the present invention.
Figure 2B:
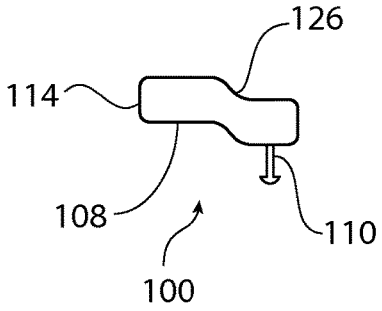
FIG. 2B shows a side view of the hearing device of FIG. 2A.
Figure 2C:
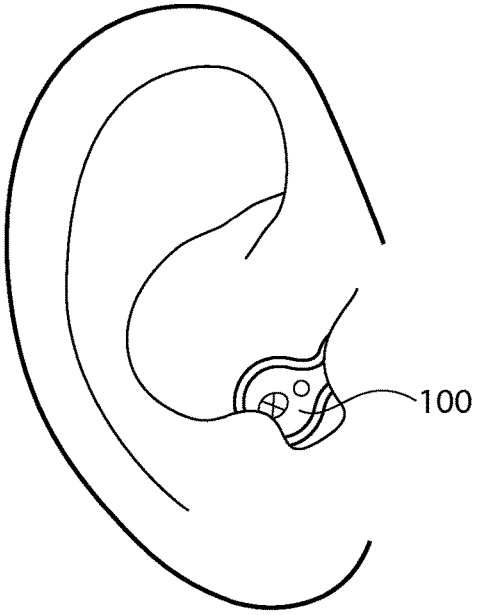
FIG. 2C shows the hearing device of FIG. 2A placed in a ear.

FIGS. 2A-2C show one example of a hearing device, generally indicated at 100, that may be used for total versatility in fitting various ear sizes and applications, while keeping the hearing device 100 all in the ear and not having to go behind the ear. This universal approach can serve all ears from children to adults or from small ear sizes to large ear sizes.

Figure 3:
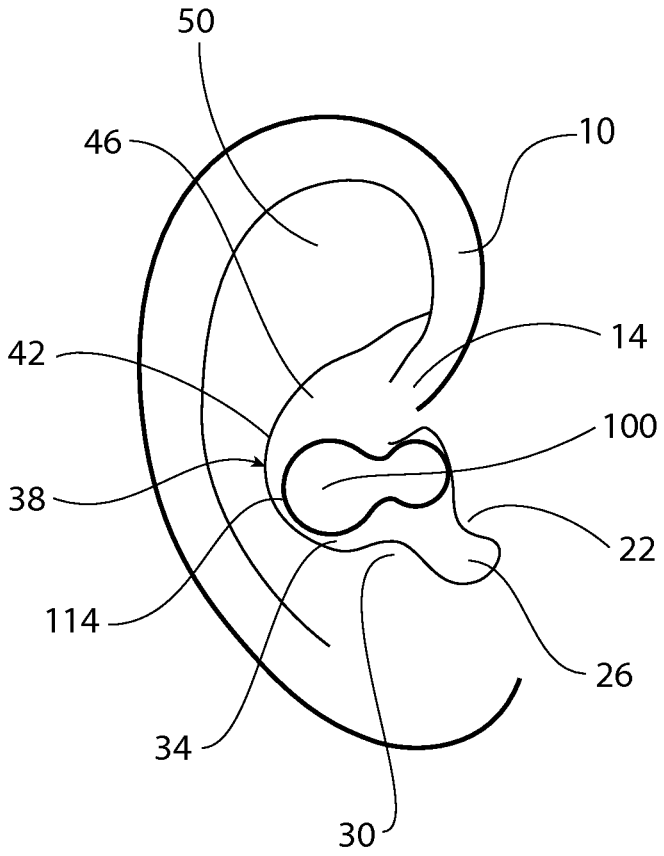
FIG. 3 shows a hearing device of the present invention place in an ear at a first position.
Figure 4:
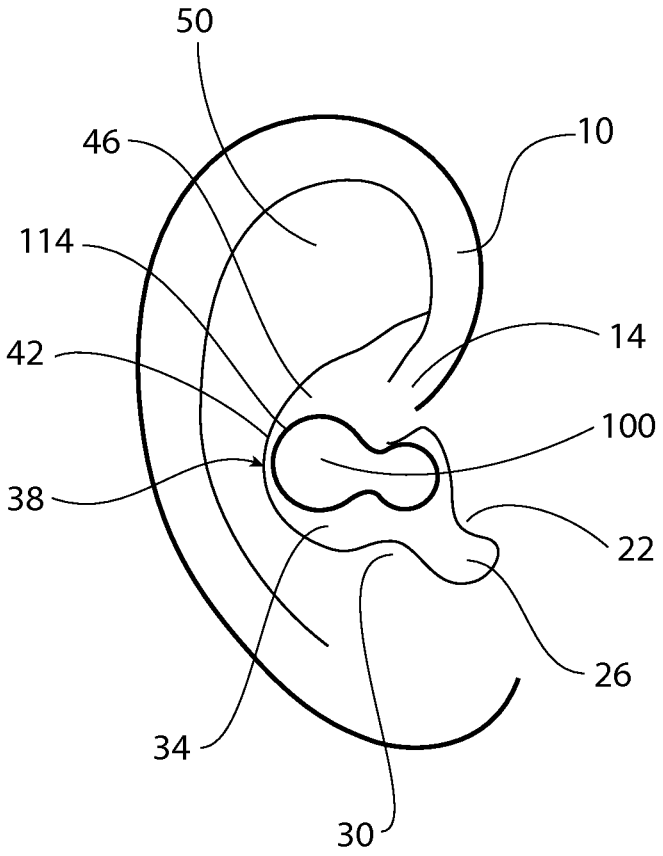
FIG. 4 shows the hearing device of FIG. 3 slidably engaged with the concha wall of the ear.

The hearing device 100 may comprise a housing 118 that defines an internal cavity in which a first microphone, an amplification circuit electrically connected to the first microphone, and a speaker electrically connected to the amplification circuit for amplifying ambient sound detected by the first microphone are located. The housing 118 may also have an arcuate outer edge 114. The arcuate outer edge 114 may be part of a larger circle 108 and configured to align with the concha area when the hearing device is placed in an ear (see FIG. 4). The arcuate outer edge 114 may allow the housing 118 to be placed in an ear (as shown in FIG. 3) and then engage the concha area of the ear by sliding the arcuate outer edge 114 along the concha wall 42 (as shown in FIG. 4), so that the hearing device 100 is stably and comfortably held in the ear regardless of the size of the particular ear.

In a preferred embodiment of the invention the hearing device may comprise a housing having a first section 108 with a substantially circular design and a second section 122 with a substantially circular design as shown in particular in FIGS. 2A and 2B. In at least one embodiment, the first section 108 is larger than the second section 122. Additionally, there may be a transition space 126 between the first section 108 and the second section 122. An outer edge of the first section 108 may be configured to align with the concha area when the hearing device 100 is placed in an ear while the second section aligns to the ear canal. This two-circle design may allow the hearing device to roll up or down in the outer ear according to whatever the person's ear shape or size is.

As will be appreciated by one skilled in the art, prior art in-ear hearing instruments can plug the ear off, creating an uncomfortable plugged up feeling. By comparison, the hearing device 100 of the present invention may have a design that allows for a true unplugged, open feeling while maintaining a small in the ear, hearing device for all ears. For example, the design may include a very slim port 110 (see FIG. 2B) that goes into the ear allowing an open ear tip to be placed on it, leaving the ear canal completely open and natural. Alternatively, a foam tip may be placed on the port for maximum hearing protection. This is a critical point to be able to provide an affordable, yet highly effective solution, for hearing enhancement or hearing protection to help tens of millions of Americans have easy access to effective solutions for their hearing needs. It will also be appreciated by one skilled in the art that the principles of the present invention may be applied to a variety of hearing devices such as hearing aids, PSAPs, etc.

On a general note, a two-circle design for a hearing device as described herein may allow for a universal fit for a variety of ears. In particular, the hearing device 100, may be able to roll up or down in the outer ear according to whatever the person's ear shape or size is. Additionally, it is believed by the inventor that the novel aspects of the hearing device 100 described herein, including the use of a slim port 110 that goes into the ear canal which is so small that it does not plug off the canal like all other in ear devices do, helps create the first in ear/open ear hearing device commercially available. In fact, the two-circle design is believed to be effective in fitting 98% of ears that it goes in.

Figure 5:
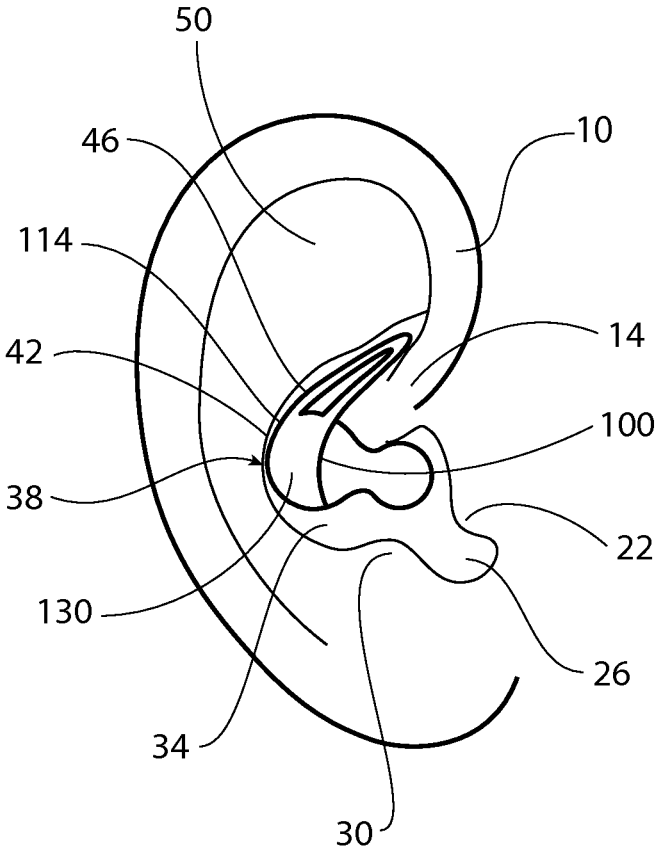
FIG. 5 shows an attachment member for securing a hearing device in an ear.

Turning now to FIG. 5 there is shown an attachment member 130 for engaging the housing of a hearing device of the present invention. The attachment member 130 may releasably engage the hearing device to aid in the retention of the hearing device when the hearing device is placed in an ear. The attachment member 130 may be manufactured in a variety of sizes such that a user may choose a particular size that best fits his or her ear to provide a more customized fit that is more comfortable and secure.

There is thus disclosed an improved hearing device that is easy to use in a substantially universal fashion.

What is claimed is:

1. A hearing device, comprising:

a housing, comprising:

a first section, the first section being rigid and having a first outer edge forming a first circle while the hearing device is being worn on an ear;

a second section having a second outer edge that forms a second circle, the second outer edge having a smaller radius than the first outer edge, the second section being configured to align with an ear canal and having the second outer edge being centered around the ear canal;

wherein the first section is configured to slidably engage the concha wall of the ear without deformation of the first circle while the second section is aligned with an ear canal of the ear.

2. The hearing device according to claim 1 wherein the housing defines an internal cavity, and located within the internal cavity is a first microphone, an amplification circuit electrically connected to the first microphone, and a speaker electrically connected to the amplification circuit for amplifying ambient sound detected by the first microphone.

3. The hearing device according to claim 1 wherein the first section is larger than the second section.

4. The hearing device according to claim 1 wherein the hearing device is a personal sound amplification product.

5. The hearing device according to claim 1 further comprising a port configured to be positioned in the ear canal, wherein the port is sufficiently slim so as to not plug off the ear canal.

6. The hearing device according to claim 5 further comprising a foam tip placed on the port for hearing protection.

7. The hearing device according to claim 1 further comprising an attachment member for engaging the housing of the hearing device.

8. The hearing device according to claim 7 wherein the attachment member releasably engages the housing and is configured to aid in retaining the hearing device in the concha area of the ear.

9. A hearing device, comprising:

a housing having a first substantially circular section and a second substantially circular section, wherein the second substantially circular section is configured to align with and be centered around an ear canal of an ear and an outer edge of the first substantially circular section is configured to slidably engage a concha wall of the ear, wherein the first substantially circular section is rigid, wherein the first substantially circular section is configured to form a circle while the hearing device is being worn on the ear without deformation of the first substantially circular section;

an attachment member releasably engaged with the housing, the attachment member overlapping at least a portion of the first substantially circular section, and the attachment member configured to extend the outer edge toward a crux of a helix of the ear to aid in retaining the hearing device in a concha area of the ear.

10. The hearing device according to claim 9 wherein the housing defines an internal cavity, and located within the internal cavity is a first microphone, an amplification circuit electrically connected to the first microphone, and a speaker electrically connected to the amplification circuit for amplifying ambient sound detected by the first microphone.

11. The hearing device according to claim 9 wherein the first substantially circular section is larger than the second substantially circular section.

12. The hearing device according to claim 9 wherein the hearing device is a personal sound amplification product.

13. The hearing device according to claim 9 further comprising a port configured to be positioned in the ear canal, the port being sufficiently slim so as to not plug off the ear canal.

14. A hearing device, comprising:

a housing having a first section and a second section, the first and second sections having substantially circular outer edges, the outer edge of the first section being rigid and configured to slidably engage a concha wall of an ear and to retain the substantially circular outer edge when engaging the concha wall without deformation of the outer edge of the first section, the second section being configured to align with an ear canal of the ear while the outer edge of the second section is centered around the ear canal;

a port extending from the second section and configured to be positioned in the ear canal, wherein the port is structured with a narrow diameter so as to leave the ear canal completely open;

wherein the housing defines an internal cavity, and located within the internal cavity is a first microphone, an amplification circuit electrically connected to the first microphone, and a speaker electrically connected to the amplification circuit for amplifying ambient sound detected by the first microphone;

wherein the first section is larger than the second section.

15. The hearing device according to claim 14 further comprising an attachment member releasably engaged with the housing and configured to extend the outer edge toward a crux of a helix of the ear to aid in retaining the hearing device in a concha area of the ear.

16. The hearing device according to claim 15 wherein the hearing device is a personal sound amplification product.

17. A hearing device, comprising:

a housing having an arcuate outer edge configured to slidably engage a concha wall of an ear;

a port configured to be positioned in the ear canal, wherein the port is structured with a narrow diameter so as to leave the ear canal completely open;

an attachment member releasably engaged with the housing and configured to extend the outer edge toward a crux of a helix of the ear to aid in retaining the hearing device in a concha area of the ear;

wherein the housing defines an internal cavity, and located within the internal cavity is a first microphone, an amplification circuit electrically connected to the first microphone, and a speaker electrically connected to the amplification circuit for amplifying ambient sound detected by the first microphone;

wherein the housing includes a first section and a second section, the first section being larger than the second section, and the arcuate outer edge being located on the first section;

wherein the first section is substantially circular and the second section is substantially circular, the second section is configured to align with an ear canal of the ear, and the port is carried by the second section.

18. The hearing device according to claim 17 wherein the hearing device is a personal sound amplification product.

19. A hearing device, comprising:

a housing having a first substantially circular section and a second substantially circular section, wherein the second substantially circular section is configured to align with and be centered around an ear canal of an ear and an outer edge of the first substantially circular section has a substantially circular outer edge and is configured to slidably engage a concha wall of the ear without deformation of the substantially circular outer edge;

an attachment member releasably engaged with the housing, the attachment member overlapping at least a portion of the first substantially circular section, and the attachment member configured to extend the outer edge toward a crux of a helix of the ear to aid in retaining the hearing device in a concha area of the ear;

wherein the first substantially circular section is larger than the second substantially circular section.

* * * * *